US006248006B1

(12) United States Patent
Mukhopadhyay et al.

(10) Patent No.: US 6,248,006 B1
(45) Date of Patent: Jun. 19, 2001

(54) CMP UNIFORMITY

(75) Inventors: Madhusudan Mukhopadhyay; Subramanian Balakumar; Chivukula Subrahmanyam; Yelehanka Ramachandramurthy Pradeep, all of Singapore (SG)

(73) Assignee: Chartered Semiconductor Manufacturing Ltd., Singapore (SG)

( * ) Notice: Subject to any disclaimer, the term of this patent is extended or adjusted under 35 U.S.C. 154(b) by 0 days.

(21) Appl. No.: 09/490,155

(22) Filed: Jan. 24, 2000

(51) Int. Cl.[7] ..... B24B 5/08
(52) U.S. Cl. ..... 451/285; 451/57
(58) Field of Search ..... 451/57, 65, 461, 451/285

(56) References Cited

U.S. PATENT DOCUMENTS

| | | | | |
|---|---|---|---|---|
| 3,660,942 | * | 5/1972 | Messerschmidt | 451/65 |
| 5,403,228 | | 4/1995 | Pasch | 451/259 |
| 5,503,592 | * | 4/1996 | Neumann | 451/461 X |
| 5,605,499 | | 2/1997 | Sugiyama et al. | 451/443 |
| 5,624,304 | | 4/1997 | Pasch et al. | 451/287 |
| 5,716,264 | * | 2/1998 | Kimura et al. | 451/285 X |
| 5,762,537 | * | 6/1998 | Sandhu et al. | 451/285 X |
| 5,810,648 | * | 9/1998 | Jiang et al. | 451/65 X |
| 5,899,745 | | 5/1999 | Kim et al. | 438/692 |
| 5,941,758 | | 8/1999 | Mack | 451/41 |
| 6,089,960 | * | 7/2000 | Messer | 451/285 |

* cited by examiner

*Primary Examiner*—Joseph J. Hail, III
*Assistant Examiner*—Anthony Ojini
(74) *Attorney, Agent, or Firm*—George O. Saile; Rosemary L. S. Pike

(57) ABSTRACT

A new apparatus is provided that allows for uniform polishing of semiconductor surfaces. The single polishing pad of conventional CMP methods is divided into a split pad, the split pad allows for separate adjustments of CMP control parameters across the surface of the wafer. These adjustments can extend from the center of the wafer to its perimeter (along the radius of the wafer) thereby allowing for the elimination of conventional problems of non-uniformity of polishing between the center of the surface that is polished and the perimeter of the surface that is polished.

7 Claims, 2 Drawing Sheets

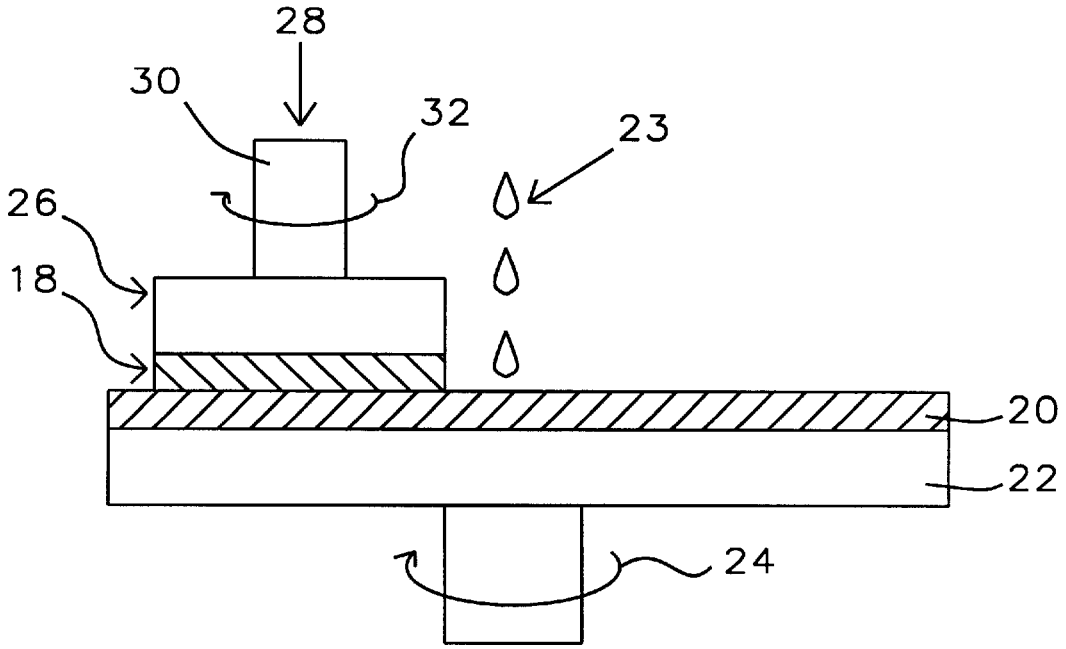
FIG. 1 – Prior Art
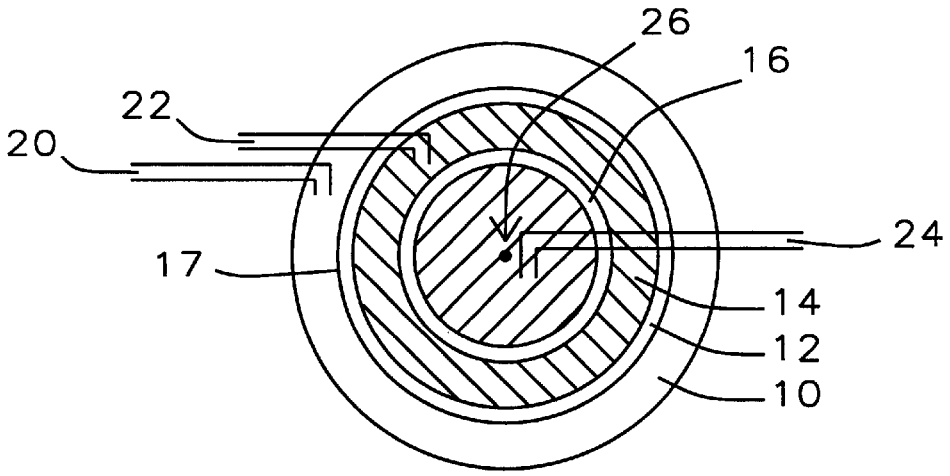
FIG. 2

CM P UNIFORMITY

BACKGROUND OF THE INVENTION (1) Field of the Invention

The invention relates to the fabrication of integrated circuit devices, and more particularly, to a method and apparatus that provide uniform polishing when applying the process of Chemical Mechanical Polishing to the surface of a semiconductor wafer.

(2) Description of the Prior Art

The present invention relates to the technology of polishing or planarizing semiconductor surfaces including substrate surfaces during or after the process of processing these surfaces. The creation of semiconductor surfaces typically includes the creation of active devices in the surface of the substrates, the polishing of semiconductor surfaces can occur at any time within the sequence of processing semiconductors where such an operation of polishing is beneficial or deemed necessary.

That good surface planarity during the creation of semiconductor devices is of prime importance in achieving satisfactory product yield and in maintaining target product costs is readily evident in light of the fact that a semiconductor device typically contains a multiplicity of layers that form a structure of one or more layers superimposed over one or more layers. Any layer within that structure that does not have good planarity leads to problems of increased severity for the overlying layers. Most of the processing steps that are performed in creating a semiconductor device involve steps of photolithography that critically depend on being able to sharply define device features, a requirement that becomes increasingly more important where device features are in the sub-micron range or even smaller, down to about 0.1 um. Planarity directly affects the impact that light has on the surface of for instance a layer of photoresist, a layer which is typically used for patterning and etching the various layers that make up a semiconductor device. Lack of planarity leads to light diffusion which leads to poor depth of focus and a limitation on feature resolution (features such as adjacent lines cannot be closely spaced, a key requirement in today's manufacturing environment). This requirement, although of a general nature, can take on special stringency dependent on the material, for instance a relatively frequently used metal such as copper, that is being polished. Copper, typically applied using the damascene process for the creation of conductive lines and vias, is one of the most promising technologies to reduce RC delay as well as to implement the shrinkage of metal interconnect line structures. Damascene is an interconnection fabrication process in which grooves are formed in an insulating layer and filled with metal to form the conductive lines. Dual damascene is a multi-level interconnection process in which, in-addition to forming the grooves of single damascene, conductive via openings also are formed. For this, Chemical Mechanical Polishing (CMP) of inlaid copper is required to form the copper wiring. One of the major problems that is encountered when polishing inlaid copper patterns is the damage that is caused on the copper trench as a consequence of the polishing process.

Chemical Mechanical Polishing (CMP) is a method of polishing materials, such as semiconductor substrates, to a high degree of planarity and uniformity. The process is used to planarize semiconductor slices prior to the fabrication of semiconductor circuitry thereon, and is also used to remove high elevation features created during the fabrication of the microelectronic circuitry on the substrate. One typical chemical mechanical polishing process uses a large polishing pad that is located on a rotating platen against which a substrate is positioned for polishing, and a positioning member which positions and biases the substrate on the rotating polishing pad. Chemical slurry, which may also include abrasive materials, is maintained on the polishing pad to modify the polishing characteristics of the polishing pad in order to enhance the polishing of the substrate.

While copper has become important for the creation of multilevel interconnections, copper lines frequently show damage after CMP and clean. This in turn causes problems with planarization of subsequent layers that are deposited over the copper lines since these layers may now be deposited on a surface of poor planarity. Isolated copper lines or copper lines that are adjacent to open fields are susceptible to damage. While the root causes for these damages are at this time not clearly understood, poor copper gap fill together with subsequent problems of etching and planarization are suspected. Where over-polish is required, the problem of damaged copper lines becomes even more severe.

During the Chemical Mechanical Planarization (CMP) process, semiconductor substrates are rotated, face down, against a polishing pad in the presence of abrasive slurry. Most commonly, the layer to be planarized is an electrical insulating layer overlaying active circuit devices. As the substrate is rotated against the polishing pad, the abrasive force grinds away the surface of the insulating layer. Additionally, chemical compounds within the slurry undergo a chemical reaction with the components of the insulating layer to enhance the rate of removal. By carefully selecting the chemical components of the slurry, the polishing process can be made more selective to one type of material than to another. For example, in the presence of potassium hydroxide, silicon dioxide is removed at a faster rate than silicon nitride. The ability to control the selectivity of a CMP process has led to its increased use in the fabrication of complex integrated circuits.

It is well known in the art that, in the evolution of integrated circuit chips, the process of scaling down feature size results in making device performance more heavily dependent on the interconnections between devices. In addition, the area required to route the interconnect lines becomes large relative to the area occupied by the devices. This normally leads to integrated circuit chips with multilevel levels of interconnect lines. The chips are often mounted on multi-chip modules that contain buried wiring patterns to conduct electrical signals between the various chips. These modules usually contain multiple layers of interconnect metallization separated by alternating layers of an isolating dielectric. Any conductor material that is used in a multilevel interconnect has to satisfy certain essential requirements such as low resistivity, resistance to electromigration, adhesion to the underlying substrate material, stability (both electrical and mechanical) and ease of processing.

FIG. 1 shows a Prior Art CMP apparatus. A polishing pad 20 is attached to a circular polishing table 22 that rotates in a direction indicated by arrow 24 at a rate in the order of 1 to 100 RPM. A wafer carrier 26 is used to hold wafer 18 facedown against the polishing pad 20. The wafer 18 is held in place by applying a vacuum to the backside of the wafer (not shown). The wafer 18 can also be attached to the wafer carrier 26 by the application of a substrate attachment film (not shown) to the lower surface of the wafer carrier 26. Slurry 23 is supplied to the surface of the wafer 20 that is being polished. The wafer carrier 26 also rotates as indicated by arrow 32, usually in the same direction as the polishing table 22, at a rate on the order of 1 to 100 RPM. Due to the rotation of the polishing table 22, the wafer 18 traverses a circular polishing path over the polishing pad 20. A force 28 is also applied in the downward vertical direction against wafer 18 and presses the wafer 18 against the polishing pad 20 as it is being polished. The force 28 is typically in the order of 0 to 15 pounds per square inch and is applied by means of a shaft 30 that is attached to the back of wafer carrier 26.

A typical CMP process involves the use of a polishing pad made from a synthetic fabric and a polishing slurry, which includes pH-balanced chemicals, such as sodium hydroxide, and silicon dioxide particles.

Abrasive interaction between the wafer and the polishing pad is created by the motion of the wafer against the polishing pad. The pH of the polishing slurry controls the chemical reactions, e.g. the oxidation of the chemicals that comprise an insulating layer of the wafer. The size of the silicon dioxide particles controls the physical abrasion of surface of the wafer.

The polishing pad is typically fabricated from a polyurethane (such as non-fibrous polyurethane, cellular polyurethane or molded polyurethane) and/or a polyester-based material. Pads can for instance be specified as being made of a microporous blown polyurethane material having a planar surface and a Shore D hardness of greater than 35 (a hard pad). Semiconductor polishing pads are commercially available such as models IC1000 or Scuba IV of a woven polyurethane material.

The mechanical configuration of a typical CMP can contain a number of different arrangements. For instance, two different polishing belts can be used whereby the first belt is essentially used to perform one type of polish (for instance a copper polish that is aimed at eliminating copper corrosion) while the second belt is essentially aimed at performing a second type of polish (for instance a TaN polish where the TaN is used as the barrier layer of a damascene structure). In many of the CMP arrangements, a belt is used to transport the wafers with the exposed, to be polished surface of the wafer facing upwards. Above and aligned with this transportation belt is an arrangement of rotating polishing heads onto which polishing pads are mounted. The rotating polishing pads are brought into contact with the surface that is to be polished while the substrate continues to proceed in the direction into which it is being transported.

A number of parameters are known that determine and control the polishing operation, these parameters are:

- downforce applied to the polishing pad, typically between 3 psi and 6 psi
- backside pressure applied to the rotating wafer, typically between 2 psi and 4 psi
- slurry flow, typically between 200 sccm and 400 sccm
- head speed, typically between 5 rpm and 20 rpm
- belt speed, typically between 75 fpm and 400 fpm, and
- DIW rinse time, typically between 0 seconds and 10 seconds and 30 seconds and 60 seconds.

It is clear that where a process of CMP is aimed at polishing a surface based on certain chemical components or materials that are present in its surface and that must be removed from the surface, the slurry composition and the resulting abrasive action of the slurry are key parameters when applying the process of CMP to the surface. Implied in the above listed parameters is that the relative speed differential between the surface of the wafer a that is being polished and the polishing pad is also one of the key parameters in determining the polishing action.

With the polishing arrangements that are presently used, the rotating polishing table contains one single polishing pad. It is clear that with one polishing pad the requirement of uniform polishing speed across the surface that is being polished is very difficult to accomplish, most notably in view of the obvious difference in relative speed between the polishing pad and the wafer surface when progressing from the center of the wafer to its perimeter. The ratio between the backpressure that is applied to the rotating wafer and the downforce that is applied to the polishing pad is the main parameter that controls the polishing action. The results of the polishing action are measured in parameters of thickness non-uniformity and surface planarity, both parameters as they relate to the surface that has been polished. The present method of using one polishing pad has the following disadvantages:

- non-uniformity of surface thickness between the center of the wafer and the wafer perimeter, and
- variation in the Depth Of Focus (DOF) across the surface of the polished wafer.

U.S. Pat. No. 5,941,758 (Mack) shows a multi-part annular polish pad that applies different pressures to different radiuses of the wafer. This invention differs from the present invention in that this invention teaches the application of different pressures to different portions of the backside of the substrate by means of a multiple pressure zone backpressure wafer carrier. Multiple air channels are provided to provide the multiple pressure zones across the backside of the substrate that is being polished. This invention does not address multiple polishing pads that are arranged in a concentric manner.

U.S. Pat. No. 5,899,745 (Kim et al.) shows a CMP with an underpad with different compression regions.

U.S. Pat. No. 5,624,304 (Pasch et al.), U.S. Pat. No. 5,605,499 (Sugiyama et al.) and U.S. Pat No. 5,403,228 (Pasch) show CMP systems for uniform CMP across wafers. U.S. Pat. No. 5,624,304 (Pasch et al.) and U.S. Pat. No. 5,605,499 (Sugiyama et al.) provide a method of mounting different polishing pads to one platen and do not provide a method of separate platen bodies. U.S. Pat. No. 5,403,228 (Pasch) shows a method of mounting a two-layer polishing pad, these polishing pads may be of different polishing hardness and thereby provide selectivity of the polishing speed across the surface of the substrate that is being polished.

SUMMARY OF THE INVENTION

A principle objective of the invention is to provide a method and apparatus for polishing semiconductor surfaces in a uniform manner.

Another objective of the invention is to provide a method and apparatus for polishing semiconductor surfaces that eliminates polishing differences between the center of the surface that is being polished and areas of the surface that extend from the center of the surface toward the perimeter of the surface.

Yet another objective of the invention is to eliminate variation in Depth Of Focus (DOF) across the surface that is being polished.

In accordance with the objectives of the invention a new apparatus is provided that allows for uniform polishing of semiconductor surfaces. The single polishing pad of conventional CMP methods is divided into a split pad, the split pad allows for separate adjustments of CMP control parameters across the surface of the wafer. These adjustments can extend from the center of the wafer to its perimeter (along the radius of the wafer) thereby allowing for the elimination of conventional problems of non-uniformity of polishing between the center of the surface that is polished and the perimeter of the surface that is polished.

BRIEF DESCRIPTION OF THE DRAWINGS

FIG. 1 shows a Prior Art wafer polishing apparatus.

FIG. 2 shows a top veiw of the polishing pads of the invention.

DESCRIPTION OF THE PREFERRED EMBODIMENTS

Figure 3:
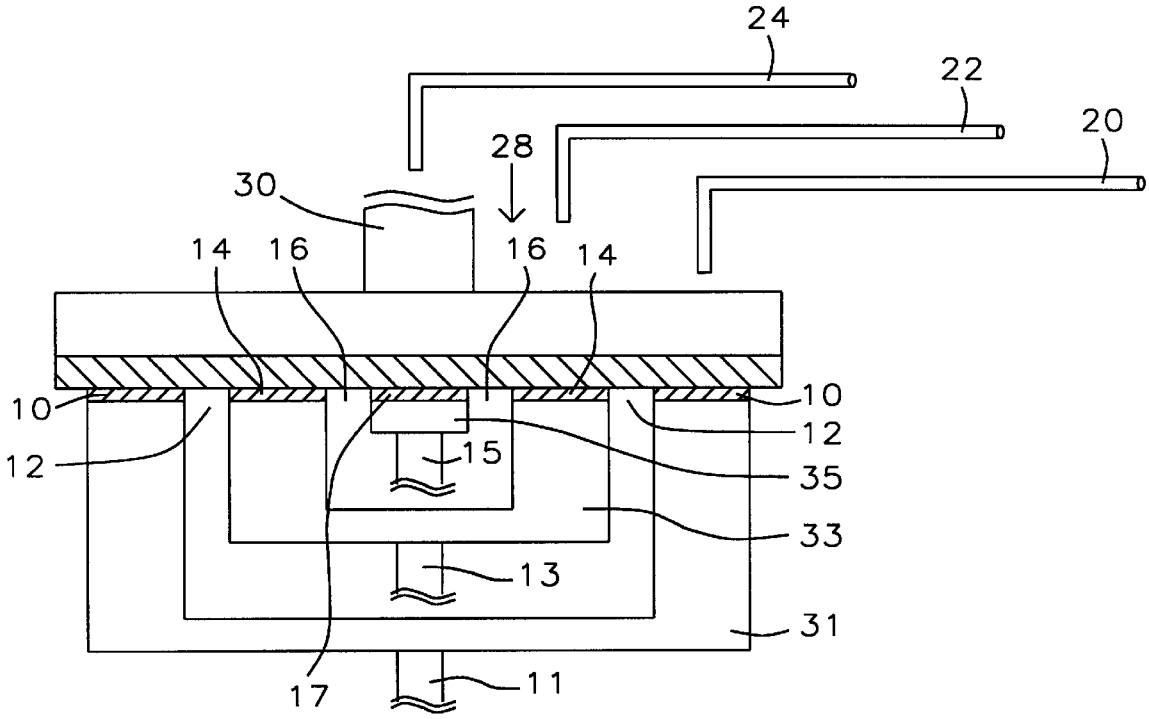
FIG. 3 shows a cross section of the polishing apparatus of the invention.

Referring now specifically to FIG. 2, there is shown a cross section of the apparatus of the invention whereby the typical one polishing pad is divided into three pads that concentrically rotate around one central axis. The central point of rotation is point 26, the three pads of the new polishing apparatus are pads 10, 14 and 17. The pad 10 is separated from pad 14 by a radial pad interval 12, the pad 17 is separated from pad 14 by a radial pad interval 16. Slurry is provided to all three pads by mutually a independent slurry supplies 20, 22 and 24. Slurry supply 20 provides the slurry for pad 10, slurry supply 22 provides the slurry for pad 14 while slurry supply 24 provides the slurry for pad 17. The polishing action of the three different and independent polishing pads 10, 14 and 18 are controlled by three different and independent drivers. These latter three different and independent drivers provide the typical CMP control parameters to the polishing pads that are attached to these drivers such as the pad pressure applied to the polishing pad and the rotational speed of the polishing pad. It is clear that the CMP apparatus provides independent control over the polishing action as it extends over the surface of the wafer that-is being polished when progressing from the center of the wafer to its perimeter. By for instance increasing the downforce applied to the central pad 17 with respect to the downforce applied to the outer polishing pad 10, the polishing action will be increased in the center of the wafer. The inverse is equally true, it is further true that the three pad arrangement of the invention lends itself to a relatively large number of combinations in controlling polishing effectiveness across the surface of the wafer by adjusting and controlling the CMP parameters that have previously been highlighted. Not only can the rotational motion of the three pads be controlled with respect to the surface that is being polished, the slurry content, angle of impact and speed of slurry delivery can be independently set and controlled for each of the three polishing heads 10, 14 and 17.

The control that can be exerted over each of the three polishing pads 10, 14 and 17 can further be correlated with and coordinated between the polishing action that takes place over each of the wafer surfaces that are affected by these polishing pads. By for instance observing polishing results while the operation of polishing is in progress, the actions and control parameters of the three pads can be adjusted (for instance by either operator intervention or by an automatic computer control system) to obtain the desired results. These results can be obtained real-time by monitoring the polishing action while the polishing process is taking place making the system of the invention a closed-loop system where final polishing results can be directly related to the expected results. Where these results are not met, the polishing process can be adjusted during the polishing process thereby avoiding yield loss.

FIG. 3 shows a cross section of the polishing apparatus of the invention. Some of the elements that are shown in FIG. 3 have previously been highlighted in FIG. 2 and can be identified as follows:

10 is the first concentric polishing pad of the invention

12 is the space that separates polishing pad 10 from the adjacent polishing pad 14

14 is the second concentric polishing pad of the invention

16 is the space that separates the second polishing pad 14 from the adjacent polishing pad 18

17 is the third concentric polishing pad of the invention

31 is the concentric polishing platform for the first polishing pad of the invention

33 is the concentric polishing platform for the second polishing pad of the invention

35 is the concentric polishing platform for the third polishing pad of the invention

11 is the rotating shaft that is attached to the back of polishing platform 31, forming the means of rotation of polishing platform 31

13 is the rotating shaft that is attached to the back of polishing platform 33, forming the means of rotation of polishing platform 33

15 is the rotating shaft that is attached to the back of polishing platform 35, forming the means of rotation of polishing platform 35

19 is the wafer that is being polished

26 is the wafer carrier table, forming the platform for mounting the semiconductor wafer

30 is the rotating shaft that is attached to the back of the wafer carrier table 26, forming the means for rotating the platform for mounting the semiconductor wafer

20 is the slurry supply for polishing pad 10, forming the means for distributing slurry across the surface of polishing pad 10

22 is the slurry supply for polishing pad 14, forming the means for distributing slurry across the surface of polishing pad 14

24 is the slurry supply for polishing pad 18, forming the means for distributing slurry across the surface of polishing pad 18, and

28 is the pressure that is exerted on the semiconductor polishing pads.

The above identified elements provide the following functions for-the process of Chemical Mechanical Polishing:

26 is a platform on which wafers are mounted shaft 30 provides the means for rotating platform 26

31, 33 and 35 provide the platforms on which semiconductor wafer polishing pads are mounted

28 provides a means for controlling the pressure that is exerted on the semiconductor polishing pad

10, 14 and 17 are three concentric mutually independent

Control parameters that are applied for controlling a polishing (CMP) process can be applied manually (by operator intervention) or under (automatic) computer control. Computer control of the polishing process can take many different forms and, since these controls are not part of the invention, do not need to be detailed at this time. Suffice it to state that these processing parameters can be controlled by a computer or by human intervention, specifics that relate to these operations are not part of the subject invention.

More sophisticated methods of implementing CMP technology can be readily derived from the process of the invention by further dividing the polishing pad into more than three pads. The limitation in further dividing the polishing pads in additional polishing pads is not imposed by the process of the invention. If such a limitation is imposed it may be imposed by the complexity of the mechanical arrangement for the implementation of a multiple pad apparatus combined with the unpredictability of the results that can be obtained if multiple polishing pads are simultaneously engaged in the process of polishing a wafer surface. Once the principle of the invention is clear, it is not difficult to extend that principle and apply it such that maximum benefits in polishing wafer surfaces can be derived.

Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications which fall within the scope of the appended claims and equivalents thereof.

What is claimed is:

1. An apparatus for chemical mechanical polishing of semiconductor wafers, comprising:

a platform for mounting semiconductor wafers;

a means for rotating said platform for mounting semiconductor wafers;

multiple concentric platforms for mounting multiple semiconductor wafer polishing pads;

a means for rotating said multiple concentric platforms for mounting said multiple semiconductor wafer polishing pads;

a means for distributing slurry across the surface of said multiple polishing; and a means for controlling pressure exerted on said multiple semiconductor polishing pads.

2. The apparatus of claim 1 wherein said multiple concentric platforms for mounting multiple semiconductor wafer polishing pads comprise a first and a second concentric polishing platform arranged in one plane, the first polishing platform being a central polishing platform, the second polishing platform being separated from said first polishing platform by a measurable first distance with said second polishing platform further extending along an extended radius of said first polishing platform over a measurable second distance.

3. The apparatus of claim 2 wherein parameters that determine chemical mechanical polishing of a polishing pad can be adjusted for each of said first and second concentric polishing platforms, said adjustments being adjustments that are dependent or independent, said adjustments being manually implemented or being implemented under computer control.

4. The apparatus of claim 1 wherein said multiple concentric platforms for mounting multiple semiconductor wafer polishing pads comprise three concentric independent polishing platforms arranged in one plane, the centrally located polishing platform being referred to as a first polishing platform of said three platform arrangement, said first polishing platform having an uninterrupted circular surface, adjacent polishing platforms being separated by a measurable distance starting with a measurable distance between said first polishing platform and an adjacent polishing platform.

5. The apparatus of claim 4 wherein parameters that determine chemical mechanical polishing of a polishing platform being adjusted for each of said three concentric polishing platforms, said adjustments being dependent or independent, said adjustments being manually implemented or being implemented under computer control.

6. The apparatus of claim 1 wherein said multiple concentric platforms for mounting multiple semiconductor wafer polishing pads comprise a multiplicity of concentric independent polishing platforms arranged in one plane, the centrally located polishing pad being referred to as a first polishing pad of said multiple pad arrangement, said first polishing pad having an uninterrupted circular surface, adjacent polishing pads being separated by a measurable distance starting with a measurable distance between said first polishing pad and an adjacent polishing pad.

7. The apparatus of claim 6 wherein parameters that determine chemical mechanical polishing of a polishing platform can be adjusted for each of said multiple concentric polishing pads, said adjustments being dependent or independent, said adjustments being manually implemented or being implemented under computer control.

* * * * *